United States Patent [19]

Owens

[11] 4,014,799

[45] Mar. 29, 1977

[54] BROMOTRIFLUOROMETHANE-CONTAINING FIRE EXTINGUISHING COMPOSITION

[75] Inventor: Robert J. Owens, Wilmington, Del.

[73] Assignee: E. I. Du Pont de Nemours and Company, Wilmington, Del.

[22] Filed: Apr. 9, 1975

[21] Appl. No.: 566,423

[52] U.S. Cl. ..... 252/8; 252/3

[51] Int. Cl.[2] ..... A62D 1/00

[58] Field of Search ..... 252/3, 8, 305

[56] References Cited

UNITED STATES PATENTS

| | | | |
|---|---|---|---|
| 2,921,897 | 1/1960 | Glendinning | 252/305 |
| 3,479,286 | 11/1969 | Gambaretto et al. | 252/8 |
| 3,656,553 | 4/1972 | Rainaldi et al. | 252/3 |

OTHER PUBLICATIONS

Chem. Abstracts, vol. 73, No. 16949j.

Chem. Abstracts, vol. 55, No. 7053g.

"Halon 1301 as a Firefighting Medium on Board Ship", Marine Engineer's Review, Aug. 1972, pp. 21–22.

Phillips, H. E., U.S. Patent Office Def. Pub. T887011.

*Primary Examiner*—Benjamin R. Padgett
*Assistant Examiner*—Deborah L. Kyle
*Attorney, Agent, or Firm*—James A. Costello

[57] ABSTRACT

A relatively small amount of a volatile compound which is completely vaporized when applied to a fire and has a heat of combustion between about 8 to 13.5 kilocalories per gram is combined with bromotrifluoromethane for use in extinguishing fires of materials having heats of combustion between about 2.5 to 5 kilocalories per gram.

5 Claims, No Drawings

BROMOTRIFLUOROMETHANE-CONTAINING FIRE EXTINGUISHING COMPOSITION

BACKGROUND OF THE INVENTION

1. Field of the Invention

This invention concerns an improved fire extinguishing composition containing bromotrifluoromethane.

2. Description of the Prior Art

The practice of introducing a fire-inert gas into the atmosphere surrounding a fire or a potential fire to extinguish or prevent fire is known. The first gases used in this application, such as carbon dioxide, operate primarily to deny sufficient oxygen to support combustion of the fuel. Other effects of such fire-inert gases are to dilute the flammable vapors and to cool the flammable vapor/air mixture. When sufficient fire-inert gas has been mixed with the atmosphere surrounding the fire site such that the flame is extinguished and new fire is prevented from igniting, the atmosphere is said to be inerted.

Volatile fluorohalocarbons containing bromine, such as $CBrF_3$, $CBrClF_2$, $CBr_2F_2$, and $CF_2Br$-$CF_2Br$ have now been found strikingly more effective in extinguishing fire than are the older fire-inert gases. Because of the great efficacy of $CF_3Br$, it has been postulated that compounds of this class extinguish fire by capturing free-radicals thus terminating flame reactions. Such compounds are called inhibitors to distinguish them from the older fire-inert gases.

In spite of their clear superiority over the older fire-inert gases, the bromine-containing fluorocarbons are only slowly finding a market because of their relatively high cost. There is a need, therefore, for new and more economical methods for using bromotrifluoromethane and similar compounds as fire extinguishants. An effective extinguishant composition containing less of the expensive fluorohalocarbon will be of value, even though limited in the type of fire it will extinguish. The measure for evaluating extinguishants of this type is the volume percent in air of the fluorohalocarbon composition necessary to extinguish the fire.

SUMMARY OF THE INVENTION

This invention concerns an improved fire extinguishant comprising bromotrifluoromethane and an effective amount of a flammable, volatile organic additive having a heat of combustion of from about 8 to 13.5 kilocalories per gram, said fire extinguishant being useful for extinguishing fires fueled by substances having heats of combustion between about 2.5 to 5 kilocalories per gram.

Preferred fire-extinguishing compositions are those containing flammable hydrocarbon additives having 1 to 7 carbon atoms.

The heat of combustion is normally defined as the amount of heat evolved by the combustion of one gram molecular weight of a substance. Herein, heats of combustion are given in kilocalories per gram. The preferred additives to be used with bromotrifluoromethane have heats of combustion between about 10 and 13.5 kilocalories per gram. The additives useful in this invention generally will have saturated-vapor pressures greater than toluene, and they will be essentially completely vaporized at 0° C.

The extinguishant comprising bromotrifluoromethane and organic additive is described as having an "effective amount" of said additive. The maximum concentration of said additive will depend upon the particular additive selected in accordance with the method for calculation of maximum concentrations of such additive that is explained following Table 3 herein. Concentrations are also dependent upon the amount of bromotrifluoromethane desired to be used in the extinguishant composition. It follows, then, that the extinguishant can have the most minute quantity of additive up to the theoretical maximum in accordance with the calculation referred to above. For practical purposes, however, about 4% to 10% of additive, by weight of the extinguishant, will provide enough additive to significantly aid in the extinguishing function while cutting down significantly on the amount of bromotrifluoromethane that is needed.

DETAILS OF THE INVENTION

A number of tests are available for evaluating fire extinguishants. The one employed in the work reported herein has been termed the "Mason jar" test. It involves slowly and steadily lowering an open container of burning fuel into a one-quart glass jar containing a known concentration of an extinguishant composition in air. The depth in the jar at which the flame is extinguished is recorded. The required composition for satisfactory flame extinguishing is that at which the fire is extinguished at one half the total depth of the jar.

It has been found that extinguishing a burning pool of a low heat of combustion material requires a higher concentration of fluorohalocarbon in air than in the case of a high heat of combustion material. For instance, extinguishing a pool of burning heptane (11.49 Kc/gm) requires about 2.8% by volume of bromotrifluoromethane in air. Extinguishing a pool of burning carbon disulfide (3.24 Kc/gm) under similar test condition requires 10.5% by volume of bromotrifluoromethane in air. Whatever the mechanism for the extinguishing of flame by bromotrifluoromethane, it seems clear that a larger amount of heat triggers the extinguishing action more effectively than a lesser amount.

With a composition containing about 4% to 10% by weight of an additive having a high heat of combustion, and the remainder bromotrifluoromethane, a carbon disulfide fire can be extinguished with a significantly lower concentration in air of the composition. For example, with a composition containing 5 weight percent of pentane and 95 weight percent of bromotrifluoromethane, a carbon disulfide fire can be extinguished with 5.2 volume percent of the composition in air (rather than 11.8 volume percent). A substantial reduction in the amount of expensive bromotrifluoromethane used can be made in this way.

Under normal, non-fire conditions, the fire-extinguishing mixture of this invention can be stored as a liquid under pressure in a pressure vessel. The $CF_3Br$ has a saturated-vapor pressure of about 200 psig at 75° F. In addition, the mixture can be pressured with nitrogen to give a total $CF_3Br$/nitrogen pressure of about 600 psig. Under a fire situation, the liquid can be discharged from the cylinder through appropriate piping and nozzles to the vicinity of the fire. Because of the high vapor pressure of the $CF_3Br$, and the volatility of the additive, the mixture is vaporized very rapidly into a gas. When the concentration of the fire extinguishing gas in air reaches the required level, the fire is extinguished.

Heats of combustion for a large number of organic compounds can be found in various handbooks, notably the "Handbook of Chemistry and Physics[ published by the Chemical Rubber Publishing Co., Cleveland, Ohio, 34th (and other) editions. Heats of combustion for a number of representative compounds are shown in Table 1,wherein the compounds with heats of combustion of above 8 are the useful additives with bromotrifluoromethane to fight fires fueled by the compounds in the Table having heats of combustion of less than 5.

There are other compounds that belong in each category that can readily be determined by recourse to the literature or to simple experimentation. The compounds listed are merely representative. Members of the same category can be used or operated upon in mixtures.

Table 1

| Material | Heat of Combustion Kilocalories/Gram |
|---|---|
| methane | 13.2 |
| ethane | 12.3 |
| diethyl ether | 8.8 |
| propane | 12.0 |
| n- and isobutane | 11.8 |
| n- and isopentane | 11.7 |
| n-hexane | 11.5 |
| n-heptane | 11.5 |
| benzene | 10.0 |
| toluene | 10.1 |
| carbon disulfide | 3.2 |
| nitromethane | 2.8 |
| methyl formate | 3.9 |
| nitroethane | 4.3 |

It has been found that a practical extinguishing mixture can be defined through use of two well-known properties of the materials involved: (1) the lower explosive concentration limit in air of the volatile flammable organic additive and (2) the concentration of bromotrifluoromethane in air required to inert said additive in air. Table 2 lists the lower explosive concentration limit in air of a number of useful compounds. Mixtures containing large amounts of an additive, even though experiments show them to be effective as extinguishants, are considered impractical. A maximum allowable proportion of additive in the mixtures is defined by a calculation involving the two properties noted above.

TABLE 2

| Lower Explosive Limit-Concentration in Air, % by Volume Compound | Concentration |
|---|---|
| methane | 5.3 |
| ethane | 3.0 |
| diethyl ether | 1.9 |
| propane | 2.2 |
| n-butane | 1.9 |
| iso-butane | 1.8 |
| n-pentane | 1.5 |
| iso-pentane | 1.4 |
| n-hexane | 1.1 |
| n-heptane | 1.2 |
| benzene | 1.3 |
| toluene | 1.2 |
| carbon disulfide | 1.3 |
| nitromethane | 7.3 |
| nitroethane | 3.4 |
| methyl formate | 5.9 |

The data in Table 2 are from the Fire Protection Handbook, Revised 13th edition published by the National Fire Protection Association, Boston, Mass.

Table 3 lists the concentration of bromotrifluoromethane in air required to inert a representative group of flammable organic materials in air. These figures are also found in the Fire Protection Handbook.

TABLE 3

| Concentration of Bromotrifluoromethane Required to Inert Flammable Material | Required Inerting Concentration in Air, % by Volume |
|---|---|
| methane | 9.0 |
| ethane | 9.5 |
| diethyl ether | 25.0 |
| propane | 9.0 |
| n-butane | 9.0 |
| iso-butane | 9.0 |
| n-pentane | 8.0 |
| iso-pentane | 8.5 |
| n-heptane | 8.0 |
| benzene | 6.1 |

Calculation of the maximum allowable concentration of flammable organic additive is as follows: Multiply the volume percent figure in Table 2 by 100 and divided the product by the sum of the volume percent figure from Table 2 and the inerting volume percent figure from Table 3. The result is the maximum volume percent of flammable organic additive to be mixed with bromotrifluoromethane. From the volume fraction of the two constituents the weight fraction can be calculated under standard conditions, using the ideal gas law. For example, using methane as additive, its maximum volume percent in the fire extinguishing mixture of the invention would be $$\frac{5.3 \times 100}{5.3 + 9.0} = 37.1\% \text{ by volume of methane.}$$

A unit volume of the gaseous extinguishing mixture would contain $$0.371 \times 16.04 \text{ (Mol. Wt. of methane)} = 5.95 \text{ units of weight}$$

and $$0.629 \times 148.9 \text{ (Mol. Wt. of bromotrifluoromethane)} = 93.7 \text{ units of weight}$$

$$\text{The percent of methane by weight} = \frac{5.95 \times 100}{5.96 + 93.7} = 6.0 \text{ wt. \%}$$

Table 4 shows the composition of some representative fire extinguishing compositions of the invention with the figures used for the calculation.

Acetone, which is not a contemplated additive of this invention, has a heat of combustion of 7.4 K cal/gram, and is considered impractical and unsafe because of the high proportions of it (in bromotrifluoromethane) that is required for effective fire extinguishment.

TABLE 4

| FLAMMABLE VOLATILE ADDITIVE IN FIRE EXTINGUISHING MIXTURE | | | | |
|---|---|---|---|---|
| | | | Maximum Allowable Vapor Concentration of Additive in $CF_3Br$ Mixture | |
| Additive | Vapor Conc. of $CF_3Br$ to Inert % by Volume | Lower Explosive Limit of Additive % by Volume | % by Volume | % by Weight |
| Methane | 9.0 | 5.3 | 37.1 | 6.0 |
| Propane | 9.0 | 2.2 | 19.6 | 6.7 |
| n-Pentane | 8.0 | 1.5 | 15.8 | 8.3 |
| n-Heptane | 8.0 | 1.2 | 13.0 | 9.1 |

Compositions containing a flammable additive in the indicated amount or less will extinguish flames of low heat of combustion materials in a lower concentration in air than will bromotrifluoromethane alone. Higher proportions of flammable additive must be avoided due to the possibility of explosion in air in the persence of an ignition source. Known explosives, such as nitroglycerine, are excluded as an additive or fuel from this application. Indications are that the lower m.w. aliphatic hydrocarbons may be the most useful additives in preparing compositions of the invention.

EXAMPLES 1 to 7

In each of the illustrative Examples the following procedure was followed.

1. The desired blend of bromotrifluoromethane/additive was mixed together.

2. A quart-size mason jar was partially evacuated and the appropriate amount (by partial pressures) of the blend was added to give the desired volumetric concentration of the air contained in the jar.

3. A container (3.49 cm I.D. × 3.18 cm long) was ¾-filled with the low energy fuel and ignited.

4. The lid was removed from the mason jar and the burning liquid slowly lowered into the bromotrifluoromethane/additive/air mixture.

5. The approximate depth at which extinguishment occurred was recorded.

6. Steps 2 through 5, inclusive, were repeated with lower concentrations of bromotrifluoromethane in the bromotrifluoromethane/additive blend each time until the extinguishment depth exceeded one-half the height of the jar. The concentration of the test immediately before this was taken to be the extinguishment concentration. results of the tests are summarized in Table 5 below.

TABLE 5

| Extinguishment of Carbon Disulfide Pool Flames | | | | | |
|---|---|---|---|---|---|
| | | Extinguishant Composition Weight Percent in Air | | Extinguishant Composition Volume percent in Air | |
| Ex. No. | Additive | Bromotrifluoromethane | Additive | Bromotrifluoromethane | Additive |
| | None | 100 | 0 | 11.8 | 0 |
| 1 | Pentane | 99 | 1 | 9.0 | 0.2 |
| 2 | Pentane | 95 | 5 | 4.7 | 0.5 |
| 3 | Pentane | 93 | 7 | 4.5 | 0.7 |
| 4 | Pentane | 90 | 10 | 4.2 | 1.0 |
| 5 | Heptane | 99 | 1 | 10.44 | 0.16 |
| 6 | Heptane | 96 | 4 | 7.34 | 0.46 |
| 7 | Heptane | 93 | 7 | 7.11 | 0.69 |

EXAMPLE 8

Another experiment was carred out using a pool of nitromethane as fuel for the fire to be extinguished, and an extinguishing composition containing by weight 95% bromotrifluoromethane and 5% n-pentane. The required volume percent in air for extinguishment employing said composition was 3.3. This is in contrast to 4.6 volume percent necessary for extinguishment by bromotrifluoromethane alone, without the additive.

The embodiments of the invention in which an exclusive property or privilege is claimed are defined as follows:

1. A fire extinguishant comprising and from about 4% to 10%, by weight, of an organic additive having a heat of combustion of from 8 to 13.5 kilocalories per gram, the remainder being bromotrifluoromethane said extinguishant being useful for extinguishing fires fueled by substances having heats of combustion between about 2.5 to 5 kilocalories per gram.

2. A fire extinguishant according to claim 1 wherein the organic additive has a heat of combustion between 10 and 13.5 K cal per gram.

3. A fire extinguishant according to claim 2 wherein the organic additive is a hydrocarbon of from 1 to 7 carbon atoms.

4. A fire extinguishant according to claim 3 comprising bromotrifluoromethane and n-heptane.

5. A fire extinguishant according to claim 3 comprising bromotrifluoromethane and n-pentane.

* * * * *

UNITED STATES PATENT OFFICE

CERTIFICATE OF CORRECTION

PATENT NO. : 4,014,799

DATED : March 29, 1977

INVENTOR(S) : Robert J. Owens

It is certified that error appears in the above-identified patent and that said Letters Patent are hereby corrected as shown below:

In the first line of Claim 1, delete "and". In the fourth line of Claim 1, insert a comma after "bromotrifluoromethane".

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*